United States Patent [19]

Johansson

[11] 4,455,687

[45] Jun. 26, 1984

[54] HEAD COVER AND SAFETY HELMET

[75] Inventor: Sven O. G. Johansson, Houston, Tex.

[73] Assignee: Helen Frances Johansson, Houston, Tex.

[21] Appl. No.: 255,795

[22] Filed: Apr. 20, 1981

[51] Int. Cl.[3] ..... A62B 17/04; A42B 3/00

[52] U.S. Cl. ..... 2/424; 2/84; 2/434; 2/171.3; 2/205; 128/201.29

[58] Field of Search ..... 2/424, 436, 410, 434, 2/84, 171.3, 202, 205, 5, 6; 128/201.23, 201.29

[56] References Cited

U.S. PATENT DOCUMENTS

| | | | |
|---|---|---|---|
| 2,870,452 | 1/1959 | DeGrazia | 2/84 X |
| 3,146,462 | 9/1964 | Militello | 2/205 X |
| 3,911,914 | 10/1975 | Johansson | 2/424 X |
| 4,138,746 | 2/1979 | Bergmann | 2/424 |
| 4,236,514 | 12/1980 | Moretti | 2/205 X |

FOREIGN PATENT DOCUMENTS

| | | | |
|---|---|---|---|
| 2224121 | 10/1974 | France | 2/434 |

*Primary Examiner*—Peter P. Nerbun

[57] ABSTRACT

A head cover and safety helmet having detachable ventilating means, and removable filter collar. The head cover, or shell, is formed of rigid material, having a face opening with a primary transparent shield yieldably mounted thereon, and multiple secondary transparent shields yieldably mounted on the primary shield, and a collar filter having novel means for mounting same in the head cover, and a novel skirt for protecting the user. The secondary shields are arranged in staggered relation, and have one end exposed so that when scratched or soiled, they may be easily removed by the user finger gripping the exposed end of the top secondary shield and pulling it free of the retaining band.

3 Claims, 5 Drawing Figures

HEAD COVER AND SAFETY HELMET

SUMMARY OF THE INVENTION

A head cover of rigid material having a face opening with a primary transparent shield yieldably mounted on said hood over said face opening and mountable on said primary shield, multiple seconary transparent shields having one end exposed for easy removal of the topmost secondary shield when it becomes scratched or soiled, and ventilating means selectively activated and extending to the top of the wall of said shell, with perforations in said ventilating means in the area adjacent said top inner wall of said shell; having a porous collar maintained in an annular conformation by means of a flexible stiffener, and releasably maintained in said hood, and a skirt extending from the lower margin of said shell adapted to fit over the shoulders and upon the torso of the user having means for selectively engaging the lower corners of said skirt to seal the skirt on the user.

BACKGROUND OF THE INVENTION

The invention herein descsribed is an improved variation of the invention made the subject matter of U.S. Pat. No. 3,911,914 issued on Oct. 14, 1975, to this Applicant, on a Ventilated Head Cover and Safety Helmet. It has been found that there are many more uses for this invention than just the sand blasting industry, for which it was originally designed, and that in the chemical industry, and various similar industries, by slight alterations, the invention was applicable. In some of these instances, the ventilating equipment is superfluous and in some a filter around the neck of the user was all that was needed to keep out the fumes that would otherwise be blown away by the ventilating means in the shell. It is an object of this invention to provide a helmet that can be easily and readily converted to meet the demands of various industries in which it may be employed.

DESCRIPTION OF THE PREFERRED EMBODIMENT

Figure 1:
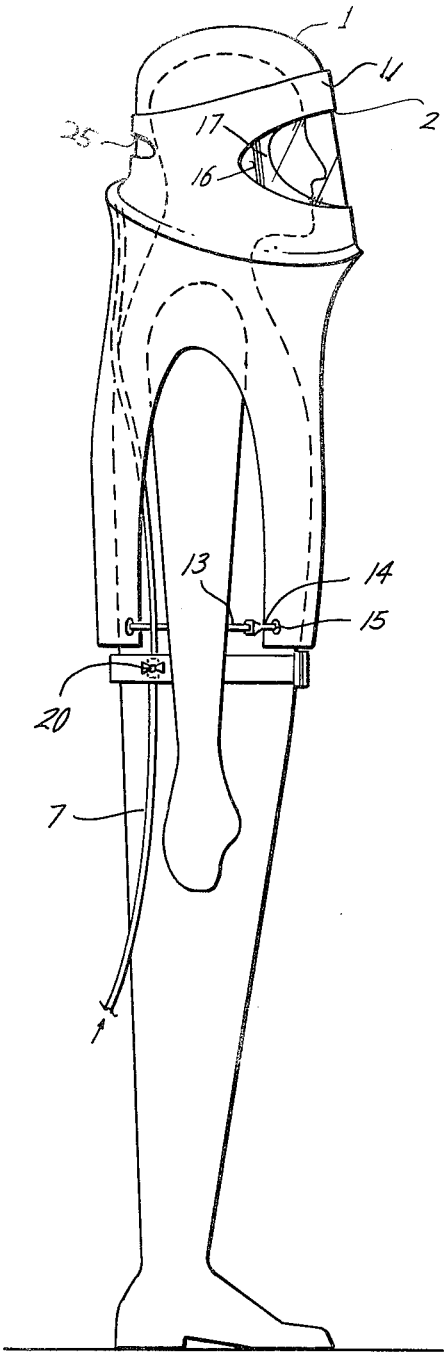
FIG. 1 is a side elevational view of the device mounted on a user.
Figure 2:
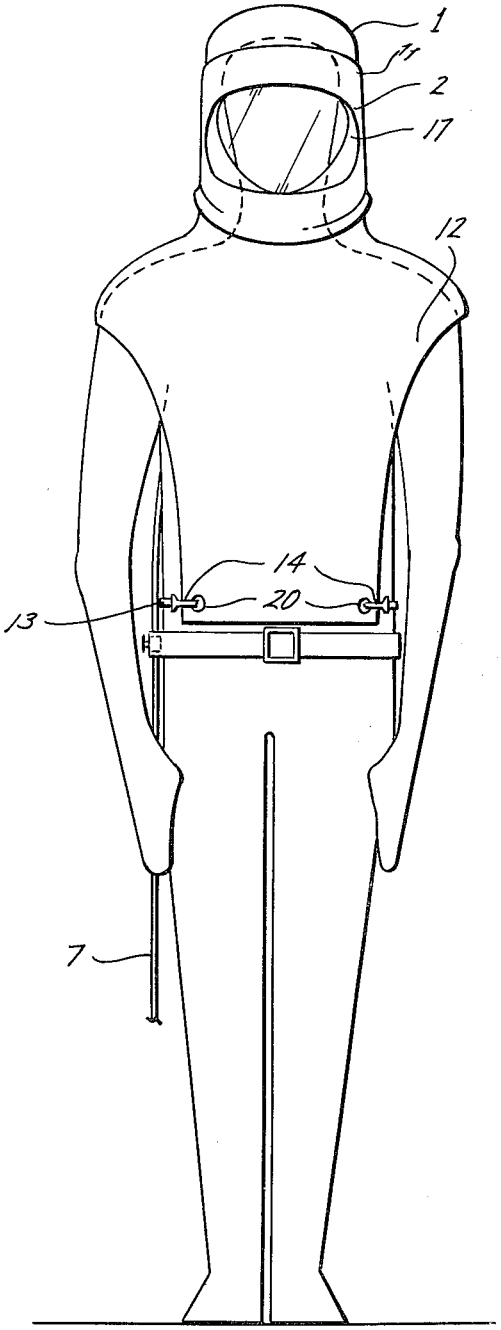
FIG. 2 is a front elevational view of the hood mounted on a user.
Figure 3:
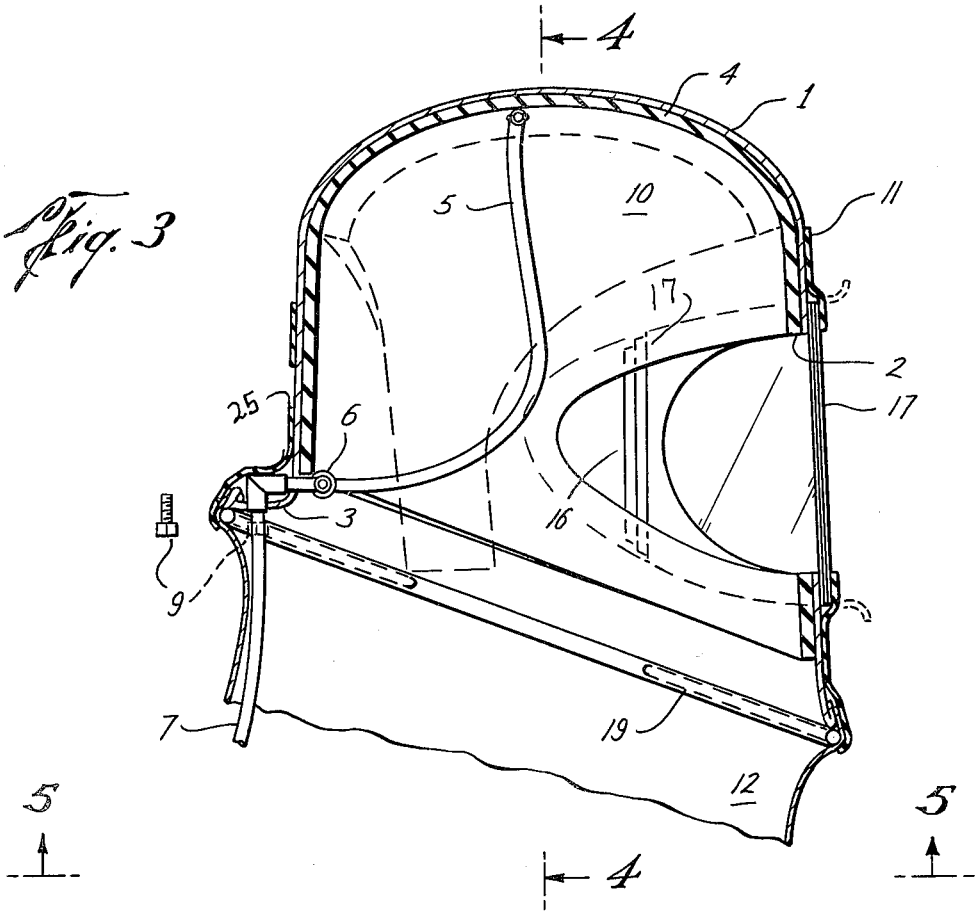
FIG. 3 is a side elevational view in cross section of the head cover.
Figure 4:
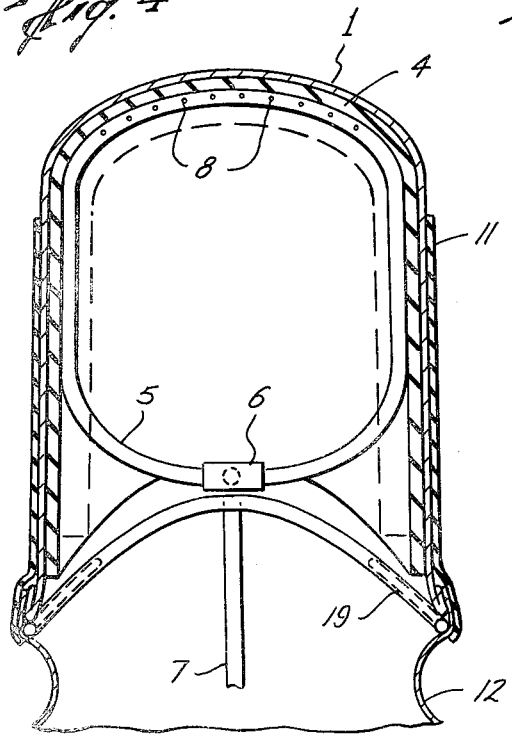
FIG. 4 is a side elevational view of the head cover, in cross section, taken on the line 4—4 of FIG. 3.
Figure 5:
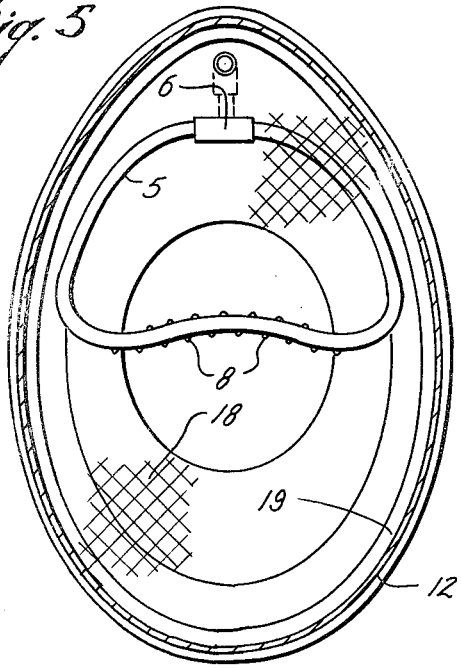
FIG. 5 is a top plan view of the inside of the helmet, taken on the line 5—5 of FIG. 3.

In the drawings, the numeral 1 designates a shell forming a head cover of rigid plastic material having a face opening 2 and being flared at the bottom as 3 and having an inner lining 4, and an air hose 5, having perforations over the uppermost portion as at 8, 9, and extending from the air hose connection 6, where an air hose as 7 extends to a source of supply (not shown), and is detachably mounted. When dismounted from the connection 6, a plug 9 is mounted in the open end of the connection 6. A loosely inserted insulation 10 fits inside the shell 1 and is formed of light plastic foam to provide a cushion for the head cover as well as a muffler for the sound of the air escaping through perforations 8.

A flexible band 11, which is tubular in conformation and has an opening cut therein for the face area, and another diametrically opposite in the form of an elongated slot. The band is mounted on the shell by stretching it over the outside area, and is pulled down so that the lower periphery of the band 11 extends below the flared area 3. A slight ridge (not shown) may be formed in the outer surface of the shell around the face opening so that an air tight seal is formed around the face opening when the band 11 is in place. A skirt 12 has an opening at one end to receive the head cover flange, and is split down each side so that it will drape over the shoulders and has the elastic straps 13, 13 to permit tight encircling of the bottom of the skirt on the torso of the user, and being provided with snap buckles 14 at one end of each strap to be received by the eyelets 20, in the opposite corner of the skirt, on each side of the skirt. The air hose 7 is secured to the belt of the user, connecting into a control valve 15, which permits adjustment of the air flow into the head cover.

A primary face shield 16 is mounted on the head cover, completely covering the face opening 2, and held in place by the band 11. To mount the primary shield, the band edge around the face opening 2 is rolled back and the shield inserted between the band and the shell 1, and the band released, covering the peripherial margin of the primary shield. On the outer surface of the primary shield 16 are mounted multiple secondary shields 17, which are slightly staggered in their alignment on the primary shield, longitudinally, and which are held in place by the band 11, the opening cut in the band for the face shield being adjacent the opening 2 in the shell, and the edge of the band, around said opening, being rolled back to receive the secondary shields inserted between the primary shield and the band, the upper and lower longitudinal margins of the secondary shields being beneath the band when it is rolled back into holding position, the ends of the secondary shields terminate short of the ends of the primary shield, and are exposed, being arranged in staggered relation to each other, so that when the secondary shield exposed to the work becomes scratched or soiled, the user may slide his fingers under the end of the topmost shield and pull it free from the band and discard it, leaving a clean secondary shield exposed to the work.

A detachable filter 18, formed of elastic porous material, is oval in contour forming a collar and yieldably maintained in the desired configuration by means of a stiffener which consists of a pliable of the plastic annular tube 19 mounted in the outer wall of said filter 18.

In use, the head cover may be used for many purposes, such as sand blasting, spray painting and the like, and when used in working with chemicals, the skirt may be omitted, if desired, the detachable filter 18, in such instances, being slipped over the head of the user, and the outer edge mounted under the band 11.

The hose 7 may be removed by disconnecting it from the connection 6, and the plug 9 inserted in the open end of the connection 6, sealing the hose 5 from debris, and anchoring the collar in the shell.

All of the parts of the device may be easily and quickly removed for cleaning or for replacement.

The band 11 is provided with a slot in the rear area to provide more elasticity to the band and to reduce the weight of the band.

What I claim is:

United States Patent [19]

Poe

[11] 4,455,688

[45] Jun. 26, 1984

[54] WELDER'S GOGGLES

[76] Inventor: Boyd L. Poe, 3735 Hermes La., Cincinnati, Ohio 45239

[21] Appl. No.: 290,365

[22] Filed: Aug. 5, 1981

[51] Int. Cl.[3] ..... A61F 9/02

[52] U.S. Cl. ..... 2/431; 2/439; 2/441; 2/430; 2/8

[58] Field of Search ..... 2/427, 430, 431, 432, 2/439, 440, 441, 447, 444, 8, 9

[56] References Cited

U.S. PATENT DOCUMENTS

| | | | |
|---|---|---|---|
| 2,598,265 | 5/1952 | Jones | 2/427 |
| 3,267,488 | 8/1966 | Colvin | 2/440 |
| 3,944,345 | 3/1976 | Decorato | 2/447 X |
| 4,114,198 | 9/1978 | Sands | 2/8 |

*Primary Examiner*—Peter P. Nerbun

*Attorney, Agent, or Firm*—Wood, Herron & Evans

[57] ABSTRACT

Welder's protective goggles particularly adapted for operators who must use corrective bifocal lenses in their work. The goggles comprise a generally tubular shaped member, having an open end contoured to fit snugly against the face about the eyes of the wearer. The axis of the open end of the tubular member is on approximately the same horizontal plane as the axes of the eyes of the wearer when looking straight ahead. The tubular member also has a closed viewing end which has at least one viewing aperture adapted to receive a safety lens. The axis of the closed viewing end intersects the axis of the open end at an angle from below it. The degree of the included angle formed by the intersecting axes is predetermined so that the tilt thus given to the closed viewing end in relation to the open end is such that the wearer of the goggles when using corrective bifocal lenses underneath them will have an unobstructed view when looking through either corrective section of the bifocal lenses. The tubular member is also provided with means for securing the goggles to the head of the wearer.

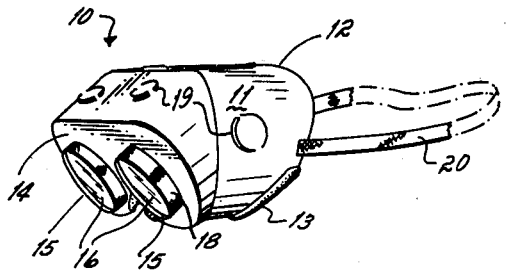

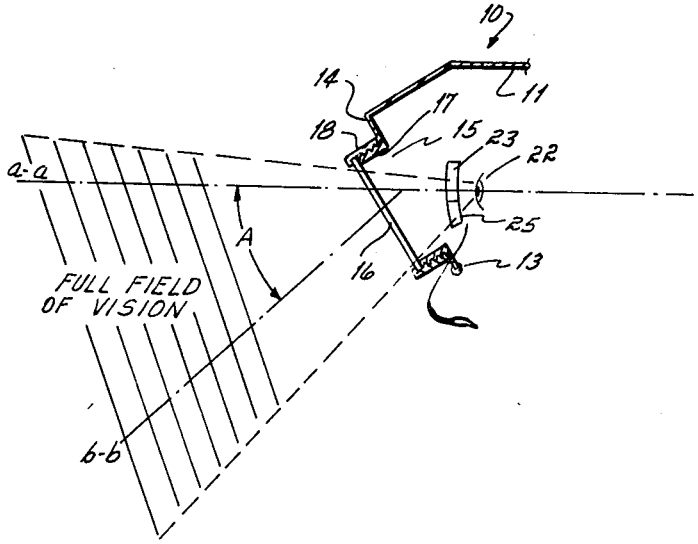

2 Claims, 4 Drawing Figures